US005575029A

United States Patent [19]

Simpson

[11] Patent Number: 5,575,029

[45] Date of Patent: Nov. 19, 1996

[54] COMBINATION TOOL

[76] Inventor: Dave Simpson, 3381 "E" Rd., Loxahatchee, Fla. 33470

[21] Appl. No.: 443,069

[22] Filed: May 17, 1995

[51] Int. Cl.[6] ..... B25B 7/22

[52] U.S. Cl. ..... 7/137; 7/107; 7/147

[58] Field of Search ..... 7/107, 132, 137, 7/143, 147, 157

[56] References Cited

U.S. PATENT DOCUMENTS

| | | | |
|---|---|---|---|
| D. 334,521 | 4/1993 | Simpson . | |
| D. 356,238 | 3/1995 | Moore et al. . | |
| 1,644,352 | 10/1927 | Perrin | 7/137 X |
| 2,572,237 | 1/1946 | Andrews . | |
| 3,947,904 | 4/1976 | Hayes . | |
| 4,104,752 | 8/1978 | Amrein et al. . | |
| 4,614,001 | 9/1986 | Liou . | |
| 4,953,248 | 9/1990 | Trombetta . | |
| 5,033,140 | 7/1991 | Chen et al. . | |
| 5,280,659 | 1/1994 | Park . | |

FOREIGN PATENT DOCUMENTS

| | | | |
|---|---|---|---|
| 597160 | 1/1948 | United Kingdom | 7/157 |

*Primary Examiner*—James G. Smith
*Attorney, Agent, or Firm*—Rick Martin

[57] ABSTRACT

A combination hand tool comprising a first and second pivoting member rotatably joined by a pivot pin. The single combination hand tool comprises means for performing multiple functions. The combination hand tool comprises a hammer head and claw, a first set of plier gripper jaws, a wire stripper and a pipe reamer.

18 Claims, 3 Drawing Sheets

COMBINATION TOOL

CROSS REFERENCE PATENTS

U.S. Pat. No. Des. 334,521 (1993) to Simpson is herein incorporated in its entirety by reference.

FIELD OF INVENTION

The present invention relates to hand tools, especially pliers. More particularly, the present invention relates to a single hand tool that can perform a variety of functions.

BACKGROUND OF THE INVENTION

Workers, especially electricians, must often work in areas in which it is difficult to get to a tool chest. These same workers, however, must often perform a variety of functions, each requiring a different tool. Workers, therefore, generally carry a multiplicity of tools in a tool belt or tool kit.

Even the most skilled worker, however, looses time removing and replacing tools in his belt. Workers also loose time searching for lost tools that they have set down at different locations. Furthermore, a tool belt with all the necessary tools can become quite heavy leading to increased worker fatigue. It is desirable, therefore, to have a single tool that provides all the necessary functions of the individual tools.

Prior art attempts at providing such a tool include the following patents:

U.S. Pat. No. Des. 334,521 (1993) to Simpson, the applicant in this application, the disclosure of which was incorporated by reference above. Applicant's design patent '521 discloses a combination tool composed of two tool halves rotatably joined by a pivot pin. Design patent '521 discloses a tool having a knurled hammer head and a standard nail removing claw, a crimper, insulated flared handles, two sets of gripping jaws, and a wire cutter.

The following elements of the present invention are not disclosed in the '521 design patent. The circumference of the hammer head of the present invention is rounded and sized to fit into the end of a 1 inch electrical pipe, and comprises a reaming edge on its lower surface. The exterior edge of hammer head of the '521 patent was square. The present invention, therefore, comprises a pipe reamer for use with pipes having one inch circumferences. The protruding nose of the present invention is designed to extract staples and finish nails, as well as, for reaming one half inch and three quarter inch pipe. No reaming edges are obvious or disclosed in the '521 design patent.

The present invention includes a wire stripper which is not disclosed in the '521 design patent. The present invention's wire stripper is a circular hole disposed adjacent to the wire cutter. The stripper hole is tapered. The stripper hole is sized such that the invention's single wire stripper may be used to strip the two most common sizes of electrical wire. The width of the wire cutter is designed to allow multiple wire and cable sizes to be cut with one wire cutter. Furthermore, the hardness of the wire cutter is designed to allow cables and wires of varying degrees of hardness to be cut with one cutter.

The second lower set of gripping jaws of the present invention comprise knurled grooves running parallel to the longitudinal axis of the present invention. This longitudinal groove design allows metal tape to be grabbed or pulled without allowing the metal tape to slip out of the s tool's grip, as is common in many prior art tools. The second lower gripping jaws of the '521 design comprise horizontal grooves running perpendicular to the tool's longitudinal axis.

U.S. Pat. No. 5,280,659 (1994) to Park discloses a multipurpose tool that comprises four working areas each having a different pair of working edges. Each set of working edges perform a function different than that performed by the other three sets of edges. The present invention differs significantly in design and further comprises a hammer head, a reamer, a crimper and nail removing claws.

U.S. Pat. No. 5,033,140 (1991) to Chen et al. discloses a multipurpose combination tool that includes a tire repair kit. The present invention is not a tire repair kit. The present invention includes the following features that are not contained in the Chen '140 patent: hammer head is knurled; a crimper; two pair of gripper jaws, one of which comprises longitudinal knurls, and the other a protruding nose; flared insulated handles; two sets of reamers; a tapered wire stripper; and the wire cutter is of a width and hardness that allows wire and cable of varying sizes and hardnesses to be cut with a single tool.

U.S. Pat. No. 4,953,248 (1990) to Trombetta discloses an electrician's compound tool comprising a hammer head, cutter blades, a series of wire strippers, a wire cutter, a knife, a crimper, a pair of blunt pliers, a bolt cutter, a claw and screw driver.

The present invention includes many features not disclosed or included in the above Trombetta '248 patent. The present invention provides the equivalent of two sets of pliers, one set having protruding nose for removing staples and the other having longitudinal knurls for gripping metal tape without the tape slipping. The present invention also provides the equivalent of two reamers for use with varying sized pipe. The wire stripper of the present invention comprises a tapered hole functioning to strip wire of varying circumferences with a single hole. Furthermore, the width and hardness of present invention's wire cutters allow the present invention to cut wire and cable of varying sizes and hardnesses.

U.S. Pat. No. 4,614,001 (1986) to Liou discloses a multipurpose pliers substantially comprising a hammer head, nail puller, wrench, flat nosed pliers, wire stripper and wire cutter. The present invention comprises the equivalent of two reamers, two sets of pliers, one set having a protruding nose, the other longitudinal knurls, and a crimper. Furthermore, the wire cutter of the present invention is of a harness and size to cut wire and cable of varying hardnesses and sizes. The wire stripper is a tapered hole configuration sized for stripping wire of varying circumference sizes with a single tool.

U.S. Pat. No. 4,104,752 (1978) to Amrein et al. discloses a multipurpose tool comprising a series of wire stripping holes of varying diameters, flat nosed gripping surfaces, wire cutting elements, a reamer element, and crimpers for crimping flexible elements. The present invention differs significantly form the '752 invention by further comprising a hammer head, nail removing claws, two gripping jaws, one having a protruding nose and the other having longitudinal knurls, flared insulated handles, and two reaming surfaces. Furthermore, the wire stripper of the present invention is a single tapered hole sized for stripping wire with varying circumferences.

U.S. Pat. No. 3,947,904 (1976) to Hayes discloses an electrician's combination tool comprising a staple puller, hammer head, a wire cutter and a wire stripper. The present invention comprises the additional elements of a knurled hammer head surface, a nail removing claw, two reamers, two pliers gripping surfaces, one having longitudinal knurls, and a crimper. Furthermore, the wire stripper of the present invention comprises a tapered hole configuration sized for stripping wire of varying diameters using a single tool.

U.S. Pat. No. 2,572,237 (1951) to Andrews discloses a combination tool having the features of a hammer, a pair of pliers, a wire cutting, and a tool for tightening wire upon a concrete form. The present invention includes the additional features of outwardly flared insulated handles, two reamers, a wire stripper and a crimper.

While it is well known to combine various tools, such as a hammer and pliers, into a single tool, the present invention solves many problems not addressed by the above prior art. The present invention combines a set of functions into one tool that have not been combined in the prior art. This combination is particularly suited to provide an electrical worker with the maximum number of functions in one tool. The present invention joins two tool halves with a pivot pin thereby providing a single tool with the following combination of functions, unknown in the prior art: outwardly flared insulated handles; a knurled hammer head; a hammer claw; a crimper; two pair of gripping jaws, one having a protruding nose and the other having longitudinal knurls; a wire cutter; and two reamers.

The various features of the combination of the present invention solve problems that are not solved by the prior art. In the prior art, a series of holes of varying diameters had to be used to strip different sizes of wire. The present invention's wire stripper is a tapered hole sized so that it allows wire of varying circumferences to be stripped using a single stripping hole.

In the prior art, wire or cable, such as ROMEX cable, had to be cut by different wire cutters having the appropriate width and hardness. The present invention's wire cutter is of a width and a hardness that allows wire and cable, such as ROMEX cable, of varying sizes and hardnesses to be cut with a single tool. Furthermore, in the prior art, tools used to grip metal fish tape often allowed the tape to slip or slide out of the tool's grip. The present invention has longitudinal knurls in its second gripping jaw. This configuration prevents metal fish tape from slipping when pulled or grabbed by the gripping jaw.

SUMMARY OF THE INVENTION

The primary object of the present invention is to provide a single hand tool for performing a variety of functions.

It is another object of the present invention to provide a single tool that will perform the functions of a hammer head, nail remover, reamer, pliers, wire stripper, wire cutter, and gripper.

It is still another object of the present invention to provide a wire stripper that will strip two sizes of the most common size of electrical wire, thereby alleviating the need to carry two sizes of wire strippers.

It is another object of the present invention to provide a wire cutter having a hardened cutting edge capable of cutting differently tempered wire.

It is another object of the present invention to provide a pair of knurled gripping jaws having parallel grooves for grabbing and pulling objects such as metal fish tape.

It is another object of the primary invention to provide a tool which saves a worker time by alleviating the need to switch individual tool usage.

It is another object of the present invention that reduces the weight of tools that a worker must carry to perform multiple functions.

The present invention provides a single hand held tool that performs all the functions of the following individual tools: a hammer head having a knurled face; a nail removing claw; two reamers for use with tubes and pipes having varying sizes circumferences; two sets of pliers, one having protruding nose, the other having longitudinal knurls; a wire stripper; a wire cutter; and a crimper.

The present invention joins two pivoting members with a pivot pin. Each pivoting member comprises a handle portion and a functional portion. The functional portion of the first pivoting member comprises a knurled hammer head and a reamer for use with 1" electrical pipe. The functional portion of the second pivoting member comprises a claw for removing nails.

The juncture of the two pivoting members provides the equivalent of two sets of pliers, a crimper, a wire cutter and a wire stripper.

Other objects of this invention will appear from the following description and appended claims, reference being had to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
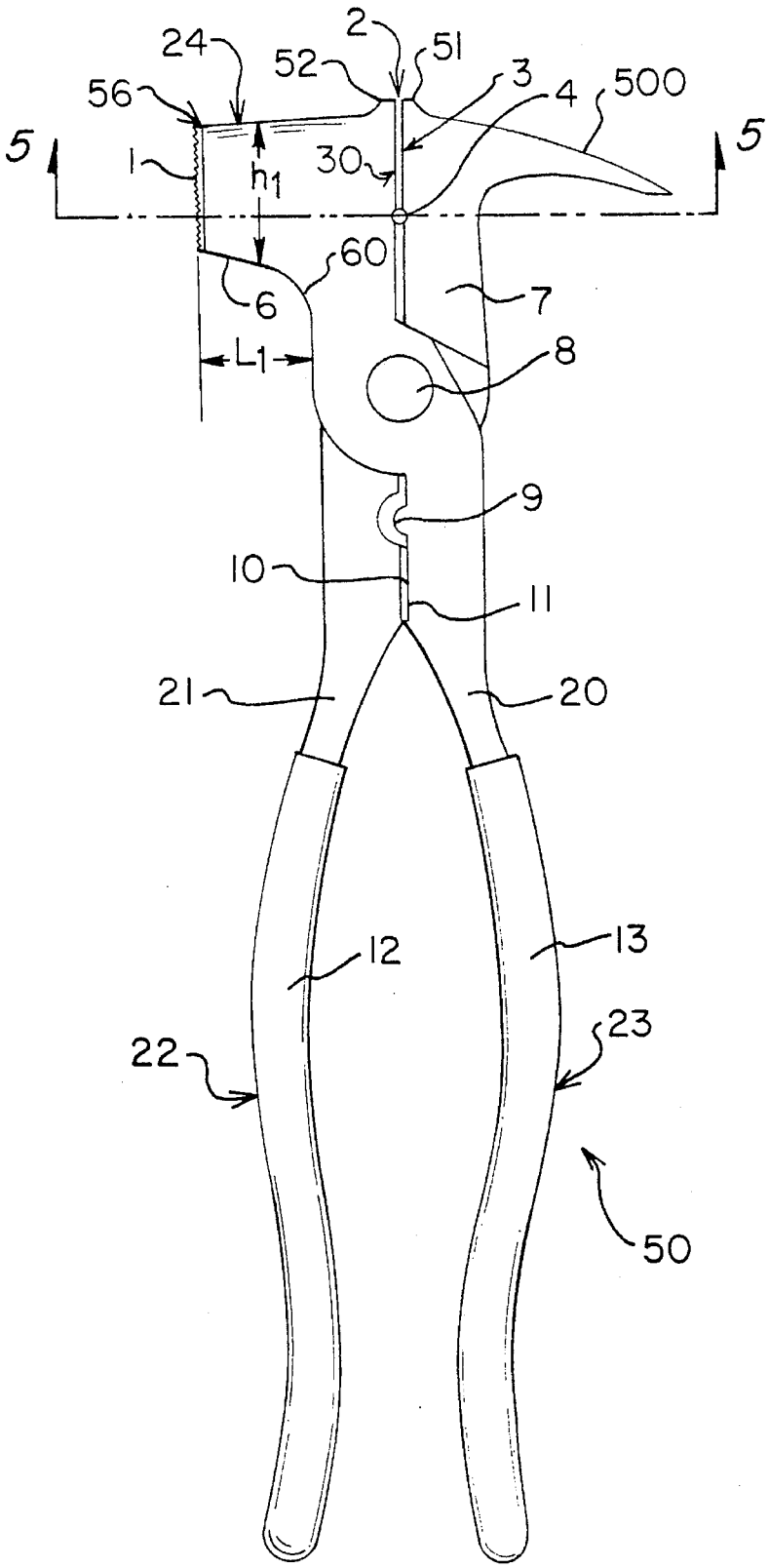
FIG. 1 is a side plan view of the present invention having the hammer head facing left.
Figure 2:
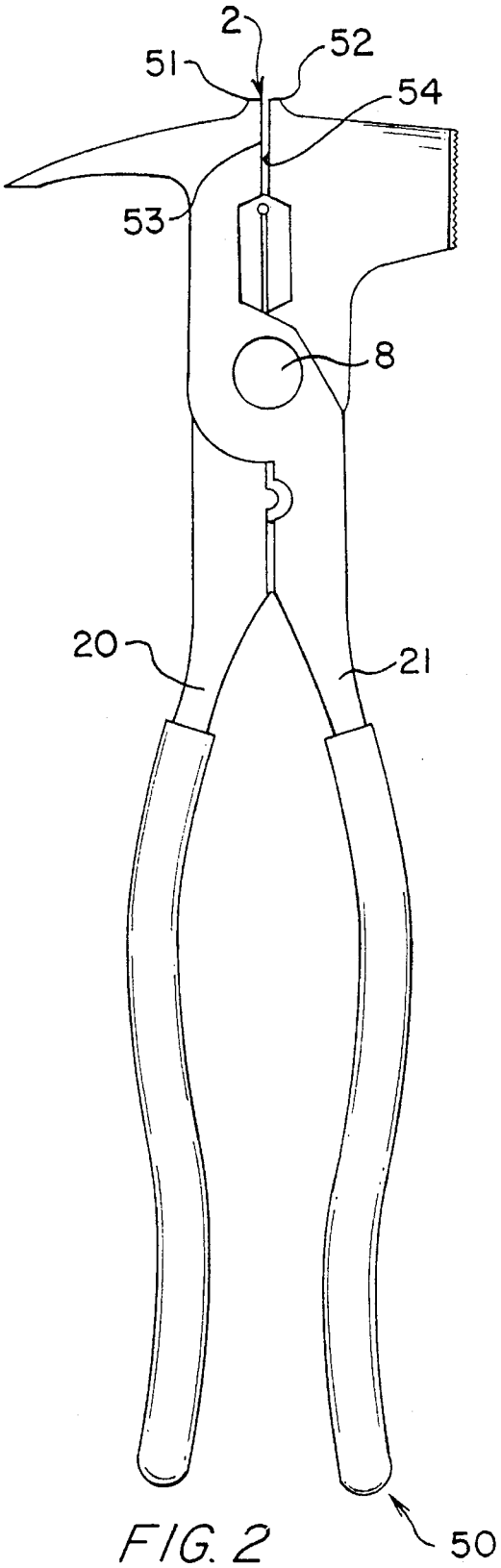
FIG. 2 is a side plan view of the present invention having the hammer head facing right.

Referring to FIGS. 1, 2 a side plan view of the present invention 50 is shown. The present invention 50 consists of single hand held tool 50 capable of performing multiple functions. The tool 50 may be constructed of metal alloys that comprise a hardness appropriate for use as a hammer head, a nail remover, a set of pliers, a crimper, a wire cutter, and a reamer. The present invention 50 is constructed of steel that has been quenched and tempered to a minimum of 150,000 P.S.I. tensile strength and 125,000 P.S. I. yield.

Two pivoting members 20, 21 are joined by pivot pin 8. The present invention 50 uses a pivot pin 8 constructed from the same material as that used to make the tool 50. The size of the pivot pin may range in size from 0.313 to 0.311 inches. The lower portion of each pivoting member 20, 21 forms a handle 22, 23. Each handle 22, 23 is flared at its distal end to protrude away from the center of the tool 50. The flared design gives a tool user better control of the tool 50, especially when it is used for pulling, prying or hammering.

The handles 22, 23 are covered with hand grips 12, 13 to help reduce the risk of electrical shock. The hand grips may be formed of an insulating material, such as rubber or plastic, having a minimum insulating factor of 600 volts. The hand grips 12, 13 also comprise a smooth finish for comfort during tool use and, most importantly, for ease of tool removal from a pocket or tool pouch.

Figure 6:
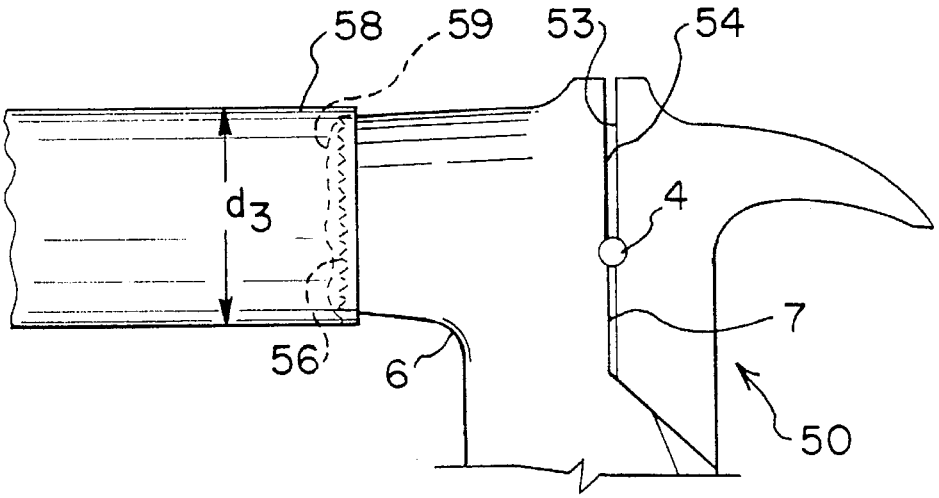
FIG. 6 is a side plan view of the present invention inserted into a one inch pipe for reaming the pipe's rough edges.

First pivoting member 20 further comprises a hammer head 24 having a knurled face 1 for driving nails and staples into wooden studs. The knurled face 1 is best seen in FIG. 6. The knurled face 1 prevents the hammer head 24 from slipping when an object is struck. Pivoting member 21 further comprises a standard claw 500 for removing nails and prying objects.

Figure 3:
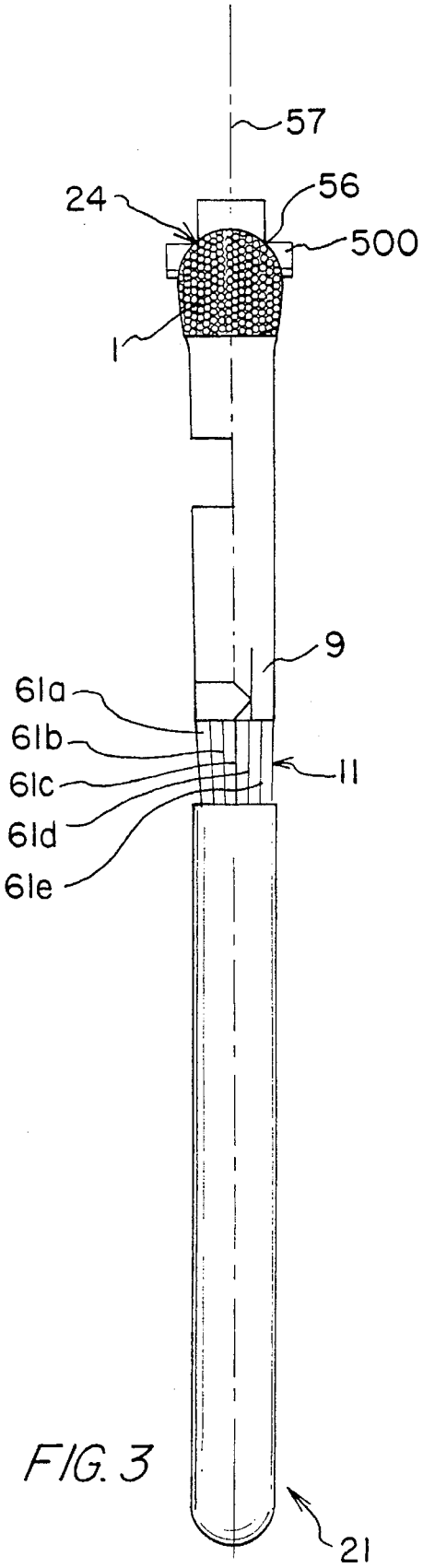
FIG. 3 is a front plan view of the hammer head pivoting member showing the knurled face of the hammer head and the longitudinal knurls of the second gripping jaw.
Figure 4:
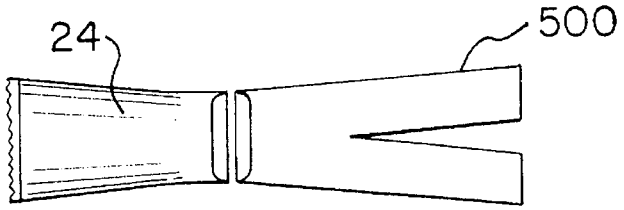
FIG. 4 is a top plan view of the present invention.

Referring to FIGS. 1, 3 and 6, the hammer head 24 includes a sharp reaming surface 60 on its lower edge 6 for smoothing a rough edge 59 of a pipe 58 having a diameter $d_3$ of one inch, referred to as a one inch pipe. The circumference 56 of the hammer head 24 is rounded and sized to fit into the end of a 1 inch pipe 58. The height of the hammer head $h_1$ may range from 0.845 to 0.855 inches and the length of the hammer head $l_1$ may range from 0.90 to 0.98 inches in order to easily ream a 1 inch pipe 58.

The hammer head 24 may be inserted into the 1 inch pipe 8 and positioned such that the reaming surface 60 contacts the rough pipe edge 59. The hammer head 24 and, consequently, the reaming surface 60 are rotated at least 360 degrees to ream the rough edge 59 of the pipe 58. The rounded circumference 56 and hammer head dimensions $d_1$, $l_1$ allow the hammer head 24 to be easily rotated. This procedure is often necessary because pipes frequently have rough edges. These edges must be smoothed to prevent damage to a wire that is pulled through the pipe.

The top inner edge 51, 52 of each pivoting members 20, 21 projects outward to form a protruding nose 2. The protruding nose 2 is designed to extract staples, including ROMEX staples, and finish nails. The protruding nose 2 can also be used to ream ½" and ¾" pipe such as electrical conduit. One side of the nose 2 is inserted into the pipe. The opposing side of the nose 2 is allowed to ride along the outer edge of the pipe. While applying a light pressure on the handles 22, 23, the pipe is rotated, thus reaming the pipe's rough edges. It will be appreciated by those skilled in the art that either side of nose 2 may be used as the reaming edge.

The internal edges 3, 30 of the pivoting member 20, 21 comprise a pair of knurled gripping surfaces 53, 54 that are used as griping surfaces or pliers. Knurled surfaces being defined as textured or ridged surfaces. The gripping surfaces 53, 54 can be used for twisting wire nuts, scotchlocks, multiple bolt heads, and standard or metric nuts. This portion can also be used to twist two or more wires together to create proper wire connections before applying wire nuts or joints.

Figure 7:
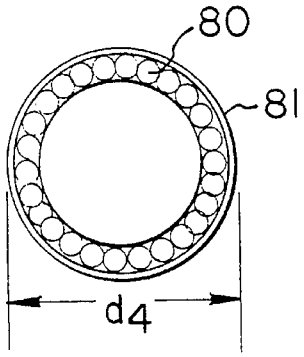
FIG. 7 (PRIOR ART)
FIG. 7 is a cross sectional view of a prior art wire having insulation and a coating.
Figure 5:
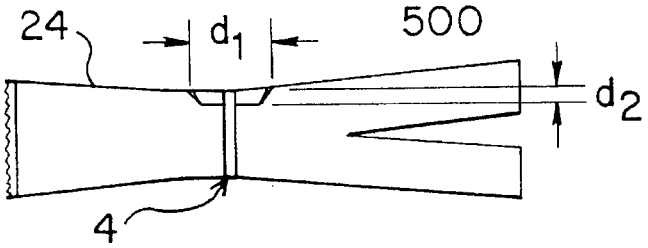
FIG. 5 is a cross sectional view taken along the cross sectional line 5—5 of FIG. 1 showing the tapered wire stripper hole.

Disposed below the knurled gripping surfaces 53, 54 is tapered hole wire stripper 4. FIG. 5 shows a cross sectional view of the tapered hole taken along cross section line 5—5 of FIG. 1. The widest diameter $d_1$ of wire stripper may be 0.085 to 0.090 inches. The depth $d_2$ of wire stripper 4 ranges from 0.025 to 0.045 inches. The diameter $d_1$ size range of wire stripper 4 allows it to strip the coating 81 and insulation 80 from the two most common sizes of electrical wire as shown in FIG. 7. The most common diameter $d_4$ sizes of prior art electrical wire being size 14 having a 0.075 inch diameter and size 12 having a 0.090 inch diameter. Wire stripper 4, therefore, alleviates the need to carry two wire strippers.

A cutting surface 7 is disposed below wire stripper 4 on the inner edges 3, 30 of pivoting members 20, 21. The cutting surface comprises a minimum length of 1 inch. This 1 inch length allows the wire cutter 7 to cut wire and cable, including ROMEX cable, having the typical range of widths in the electrical field. The cutting edge 7 is also hardened to at least 150,000 P.S.I. tensile strength. This tensile strength is sufficiently hard to allow cutting edge 7 to cut wires and cables having a wide range of hardnesses.

Below pivot pin 8 on the inner surfaces of pivoting members 20, 21 a crimper 9 is disposed. The crimper 9 is used to crimp electrical wire connections such as butt splices and terminals.

A second pair of gripping jaws 10, 11 are provided beneath the crimper 9. The gripping jaws 10, 11 comprise longitudinal grooves, called knurls, running parallel to longitudinal axis 57. The gripping jaws 10, 11 are designed for grabbing and pulling objects such as electrician's metal fish tape. The longitudinal grooves run counter to the surface design of the metal fish tape, thereby creating a friction. This allows the present invention 50 to securely grip fish tape and the like without the tape slipping or sliding free of the tool's 50 grip.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A combination hand tool, comprising:

a first and a second pivoting member, said first pivoting member having a handle, an external and an internal edge and an external and internal surface and said second pivoting member having a handle, an external and an internal edge and an external and internal surface;

a pivot pin for rotatably joining said first and second pivoting members together, whereby said internal edges of said first and second pivoting members may be displaced towards or away from each other;

hammer means, disposed on said external surface of said first pivoting member, for driving an object into a material, said hammer means having a lower edge;

claw means, disposed on said external surface of said second pivoting member, for removing said object from said material;

a first pliers means, disposed on said internal surfaces of said first and second pivoting members, for gripping an object;

stripper means, disposed on said internal surfaces of said first and second pivoting members below said first pliers means, for stripping a wire; and reamer means, disposed on said lower edge of said hammer means, for reaming a pipe.

2. The combination hand tool of claim 1, further comprising cutter means, disposed on said internal surface of said first and second pivoting members below said stripping means, for cutting a wire or a cable.

3. The combination hand tool of claim 2 further comprising crimper means, disposed on said internal surfaces of said first and second pivoting members below said pivot pin, for crimping an object.

4. The combination hand tool of claim 3 further comprising a second pliers means, disposed on said internal surfaces of said first and second pivoting members below said crimper means, for gripping an object.

5. The combination hand tool of claim 4, wherein said hammer means is a conventional hammer head having a knurled face and said claw means is a conventional hammer claw.

6. The combination hand tool of claim 5, wherein said first pliers means further comprises a protruding nose, functioning to allow easy removal of a finish nail or a staple.

7. The combination hand tool of claim 6, wherein said first pliers means further comprises a reaming edge functioning to smooth an edge of a pipe.

8. The combination hand tool of claim 7, wherein said stripper means further comprises a tapered hole design functioning to allow at least two different wire sizes to be stripped of a coating using a single wire stripper hole.

9. The combination hand tool of claim 8, wherein said cutter means is at least one inch long, functioning to allow wide range of cable and wire sizes to be cut.

10. The combination hand tool of claim 9, wherein said cutter means comprises a hardness of at least 150,000 P.S.I. tensile strength, functioning to allow cutting a cables and wires having a wide range of hardnesses.

11. The combination hand tool of claim 10, wherein said second pliers means further comprises longitudinal knurls running parallel to a longitudinal axis of said tool, functioning to allow a metal tape to be gripped without said metal tape slipping.

12. The combination tool of claim 11, wherein said stripper means further comprises a maximum diameter ranging from 0.085 to 0.090 inches, functioning to allow wire having a diameter ranging from 0.075 to 0.090 inches to be stripped.

13. The combination tool of claim 12, wherein said handle further comprises a hand grip functioning to reduce the risk of electrical shock and allow easy removal of said tool from a pocket or a tool container.

14. A hand held tool for performing multiple functions, comprising:

a first and a second pivoting members, said first pivoting member having a handle, an external and an internal edge and an external and internal surface and said second pivoting member having a handle, an external and an internal edge and an external and internal surface;

a pivot pin for rotatably joining said first and second pivoting members together;

a hammer head, disposed on said external surface of said first pivoting member, for hammering a nail and a staple into wood, said hammer head having rounded circumference and a lower edge extending from said hammer head to below said pivot pin;

a claw, disposed on said external surface of said second pivoting member, for removing said nail and staple from said wood;

a first set of gripping jaws, disposed on said internal surfaces of said first and second pivoting members below said pivot pin, said first set of gripping jaws comprising longitudinal grooves, running parallel to a longitudinal axis of said hand tool, for gripping an object; and said lower edge of said hammer head further comprises a sharp reaming edge, functioning to smooth a rough edge of a pipe having a one inch diameter.

15. The hand held tool of claim 14 further comprising:

a second set of gripping jaws disposed on said internal surfaces of said first and second pivoting members above said pivot pin, said second set of gripping jaws having a protruding nose, functioning to allow easy removal of a finish nail and a staple;

a cutter disposed on said internal surfaces of said first and second pivoting members below said stripping means, functioning to cut a wire and a cable; and a stripper disposed on said internal surfaces of said first and second pivoting members below said second set of gripping jaws functioning to strip said wire of a coating and an insulation.

16. The hand held tool of claim 15 further comprising a crimper disposed on said internal surfaces of said first and second pivoting members below said pivot pin functioning to crimp a wire connection.

17. The hand held tool of claim 16, wherein said stripper comprises a predetermined diameter size, said predetermined diameter size functioning to allow two sizes of wire to be stripped using a single stripper.

18. The hand held tool of claim 17, wherein said cutter is at least one inch long and comprises a hardness of at least 150,000 P.S.I. tensile strength.

* * * * *